US011830332B2

(12) United States Patent
Koniar et al.

(10) Patent No.: US 11,830,332 B2
(45) Date of Patent: Nov. 28, 2023

(54) VIBRATION TRIANGULATION NETWORK

(71) Applicant: Alarm.com Incorporated, Tysons, VA (US)

(72) Inventors: Daniel John Koniar, Bloomington, MN (US); Liyu Yao, McLean, VA (US); Martin Logan Elliott, Frederick, MD (US); William Wireko Mensah, Fairfax, VA (US); John Zhang, Chicago, IL (US)

(73) Assignee: Alarm.com Incorporated, Tysons, VA (US)

( * ) Notice: Subject to any disclaimer, the term of this patent is extended or adjusted under 35 U.S.C. 154(b) by 71 days.

(21) Appl. No.: 17/199,003

(22) Filed: Mar. 11, 2021

(65) Prior Publication Data

US 2021/0287501 A1 Sep. 16, 2021

Related U.S. Application Data

(60) Provisional application No. 62/988,717, filed on Mar. 12, 2020.

(51) Int. Cl.

| | |
|---|---|
| ***G08B 13/16*** | (2006.01) |
| ***G08B 29/22*** | (2006.01) |
| ***G08B 21/22*** | (2006.01) |

(52) U.S. Cl.
CPC ..... *G08B 13/1609* (2013.01); *G08B 21/22* (2013.01); *G08B 29/22* (2013.01)

(58) Field of Classification Search
CPC ..... H04W 4/029; H04W 4/20; G08B 7/062; G08B 21/02; G01H 1/00; G01V 1/22
See application file for complete search history.

(56) References Cited

U.S. PATENT DOCUMENTS

| | | | | |
|---|---|---|---|---|
| 2016/0189531 | A1* | 6/2016 | Modi | G08B 29/188 340/506 |
| 2020/0065433 | A1* | 2/2020 | Duff | G01S 19/48 |
| 2020/0068354 | A1* | 2/2020 | Stapleford | H04W 4/029 |
| 2021/0141106 | A1* | 5/2021 | Pearson | G01H 1/00 |
| 2021/0183217 | A1* | 6/2021 | Tran | G08B 7/062 |

* cited by examiner

*Primary Examiner* — Mirza F Alam
(74) *Attorney, Agent, or Firm* — Fish & Richardson P.C.

(57) ABSTRACT

Techniques and systems are described for creating and operating a vibration triangulation network. The network can include vibration sensor devices placed in a building, such as a store or a house, which are able to pinpoint the location of a target, e.g., person, animal, etc., through triangulation. A described technique includes receiving vibration notifications from vibration sensor devices, determining a location of a target within the building based on at least a portion of the vibration notifications and a vibration sensor map associated with the building, and triggering an alarm event based on a detection of the target.

20 Claims, 8 Drawing Sheets

VIBRATION TRIANGULATION NETWORK

CROSS REFERENCE TO RELATED APPLICATION

This disclosure claims the benefit of the priority of U.S. Provisional Patent Application No. 62/988,717, entitled "VIBRATION TRIANGULATION NETWORK" and filed on Mar. 12, 2020. The above-identified application is incorporated herein by reference in its entirety.

TECHNICAL FIELD

This disclosure relates to triangulation and vibration measurements.

BACKGROUND

A positioning technique may use triangulation to determine a position of an object. For example, wireless base stations can take signal strength measurements of radio frequency (RF) signals transmitted by a cell phone, forward the measurements to a centralized server, and the centralized server can compute a position of the cell phone using triangulation. Alternatively, the cell phone may take signal strength measurements of RF signals received from different base stations, and then use these measurements to determine a position of the cell phone.

SUMMARY

Techniques and systems are described for creating and operating a vibration triangulation network. A vibration triangulation network can include vibration sensor devices placed in a building, such as a store or a house, which are able to pinpoint the location of a target, e.g., person, animal, etc., through triangulation. According to an aspect of the present disclosure, a described technique includes receiving vibration notifications from vibration sensor devices, determining a location of a target within the building based on at least a portion of the vibration notifications and a vibration sensor map associated with the building, and triggering an alarm event based on a detection of the target. In some implementations, the described technique includes receiving vibration notifications from the vibration sensor devices, detecting a target within the building based on at least a portion of the vibration notifications and the vibration sensor map associated with the building, and triggering an alarm event based on the detected target within the building and one or more alarm criteria. Other implementations include corresponding systems, apparatus, and computer programs to perform the actions of methods defined by instructions encoded on computer readable storage.

These and other implementations can include one or more of the following features. The technique can include performing a calibration process on vibration sensor devices within a building such as a house or a store, obtaining layout information of the building, and determining locations of the vibration sensor devices located in the building with respect to the layout information to create a vibration sensor map. In some implementations, a vibration sensor device can transmit a vibration notification via a short-range wireless communication link such as Wi-Fi, Bluetooth, or Z-Wave. In some implementations, a vibration notification includes a sensor identifier, a vibration level (e.g., amplitude), and timestamp. A vibration sensor map can include sensor location entries for respective sensor devices. In some implementations, a sensor location entry can include a room identifier and a sensor identifier. In some implementations, a sensor registration entry can include a sensor identifier and sensor coordinates. The technique can include filtering vibrations based on vibrational amplitudes and a predetermined amplitude criterion. For example, the technique can exclude vibrations having an amplitude below a predetermined threshold value. In some implementations, the technique can exclude vibrations that originate from known sources such as a washer, dryer, or dishwasher. Excluding vibrations can include analyzing a pattern of vibrations, and excluding vibrations that have a specific pattern, e.g., slow vibration, fast vibration, etc. In some implementations, the technique includes determining a path of intruder within the building based on the vibration notifications, determining what rooms the intruder entered, determining a number of intruders, or a combination thereof.

According to an aspect of the present disclosure, a described system includes a controller and three or more vibration sensor devices located in a building. Each of the vibration sensor devices can include a vibration sensor, processor coupled with the vibration sensor, and a communication module coupled with the processor. A vibration sensor device can include a battery or other type of power source. Each of the vibration sensor devices can be configured to transmit a vibration notification in response to one or more detected vibrations. The controller can be configured to receive vibration notifications from the vibration sensor devices and detect a moving target within the building based on at least a portion of the vibration notifications and a vibration sensor map associated with the building. The vibration sensor map can include location data for each of the vibration sensor devices. In some implementations, the controller is configured to trigger an alarm event based on a detection of the moving target within the building and one or more alarm criteria.

According to an aspect of the present disclosure, a described technique includes determining the locations of vibration sensor devices within a building such as a store, amusement park, or office space, creating a vibration sensor map based on the sensor locations, receiving vibration notifications from the vibration sensor devices, determining locations of targets based on the vibration notifications and the vibration sensor map, and creating a heat map showing customer activity within the building. In some implementations, the technique includes aggregating the target locations on a map of the store to generate one or more heat maps of customer movement for the building.

According to an aspect of the present disclosure, a described technique includes receiving, by a controller, vibration notifications from vibration sensor devices distributed within a building; accessing, by the controller, a vibration sensor map associated with the building, the vibration sensor map including sensor location entries for the vibration sensor devices; determining a location of a target based on at least a portion of the vibration notifications and the vibration sensor map; and triggering an alarm event based on a detection of the target within the building and one or more alarm criteria. Other implementations include corresponding systems, apparatus, and computer programs to perform the actions of methods defined by instructions encoded on computer readable storage.

These and other implementations can include one or more of the following features. Implementations can include filtering one or more of the vibration notifications that correspond to one or more vibrations originating from one or more predetermined vibration sources. In some implementations, for determining the location of the target, the at least the portion of the vibration notifications can correspond to one or more vibrations that originate from locations other than the one or more predetermined vibration sources. In some implementations, each of the vibration notifications includes a sensor identifier, a vibration amplitude, and a timestamp. Implementations can include filtering one or more of the vibration notifications based on the respective vibrational amplitudes and a predetermined amplitude criterion, wherein the at least the portion of the vibration notifications satisfy the predetermined amplitude criterion.

In some implementations, the one or more alarm criteria specifies a restricted area of the building, and wherein triggering the alarm event comprises triggering the alarm event based on a detection of the target within the restricted area of the building. Implementations can include determining a path of the target within the building based on the vibration notifications; identifying one or more rooms of the building that the target entered based on the path; and generating a list of one or more room identifiers corresponding to the identified one or more rooms.

Implementations can include performing a calibration process on the vibration sensor devices; obtaining layout information of the building; and determining locations of the vibration sensor devices located in the building with respect to the layout information. The sensor location entries can respectively include the determined locations. In some implementations, each of the sensor location entries includes a sensor identifier, a room identifier, and sensor coordinates. Performing the calibration process can include selecting a vibration sensor device to calibrate; and providing a notification to prompt a user to walk in a room containing the selected vibration sensor device to obtain a vibrational baseline for that device.

Particular configurations of the technology described in this disclosure can be implemented so as to realize one or more of the following potential advantages. The use of a vibration triangulation network can detect the presence of people. The network can provide detailed information about people's movements including the locations visited, timestamps of when someone entered or left a property or a room, and the number of people that were present. Further, vibration sensor devices can offer several advantages over other types of sensors such as cameras. For example, vibration sensors can be discrete, easily hidden, resilient to tampering, and/or located in places where cameras are not appropriate such as bedrooms, bathrooms, and changing rooms. Vibration triangulation networks can be integrated with a variety of systems such as security, monitoring, business planning, and environmental systems. Vibration triangulation networks can be combined with other sensors such as a door sensor to provide more detailed information such as whether a door was opened from the inside or outside.

The details of one or more implementations are set forth in the accompanying drawings and the description below. Other features will be apparent from the description and drawings.

DETAILED DESCRIPTION

A vibration triangulation network can include vibration sensor devices placed in a building, such as a store or a house, to pinpoint the location of a target through triangulation. The network can track movement of one or more targets such as people, animals, vehicles, and other moving objects within proximity of the network. A vibration triangulation network can be used for security and monitoring purposes. Such a network can also be used for business related purposes such as studying customer behaviors within a store.

From a security standpoint, a security system can include a vibration triangulation network to provide a valuable dataset of movement around a user's property. For example, in the case of a break-in, the user can access the security system to retrieve information such as a timestamped path of movement of the intruder. A vibration triangulation network can produce information such as the time when an intruder entered the property, how many intruders, where they went inside, how long they spent in each room, and when they left. A vibration sensor network deployed in a house may determine, for example, that two robbers entered the house at 3:42 AM, spent four minutes in the kitchen, then went to the bedroom where they spent two minutes, and finally spent three minutes in the living room before leaving at 3:51 AM. Police may use this information to apprehend suspects and determine the extent of what was taken. Such information can provide details of where items were taken from such as from a particular room or near a safe. Such information can also provide information on where items were not taken from, e.g., no vibrations in a master bedroom can indicate that the robbers did not take items from that room. Further, vibration sensor devices can offer several advantages over other types of sensors such as cameras. For example, vibration sensor devices can be discrete, easily hidden, resilient to tampering, and/or located in places where cameras are not appropriate such as bedrooms, bathrooms, and changing rooms.

Vibration triangulation networks can also provide monitoring and automation functionality. For example, the network can detect the presence of a person and output a detection event that causes a light to turn on or causes a camera to take a picture. The network can be integrated into an environmental system such as a heating, ventilation, and air conditioning (HVAC) system. For example, a controller can trigger the HVAC system to stop cooling a property if there is a lack of detection events for a predetermined period of time. Further, vibration triangulation networks can be deployed in geo-fencing applications. For example, a controller can trigger an alarm if motion is detected in a user-defined boundary by the network.

Figure 1:
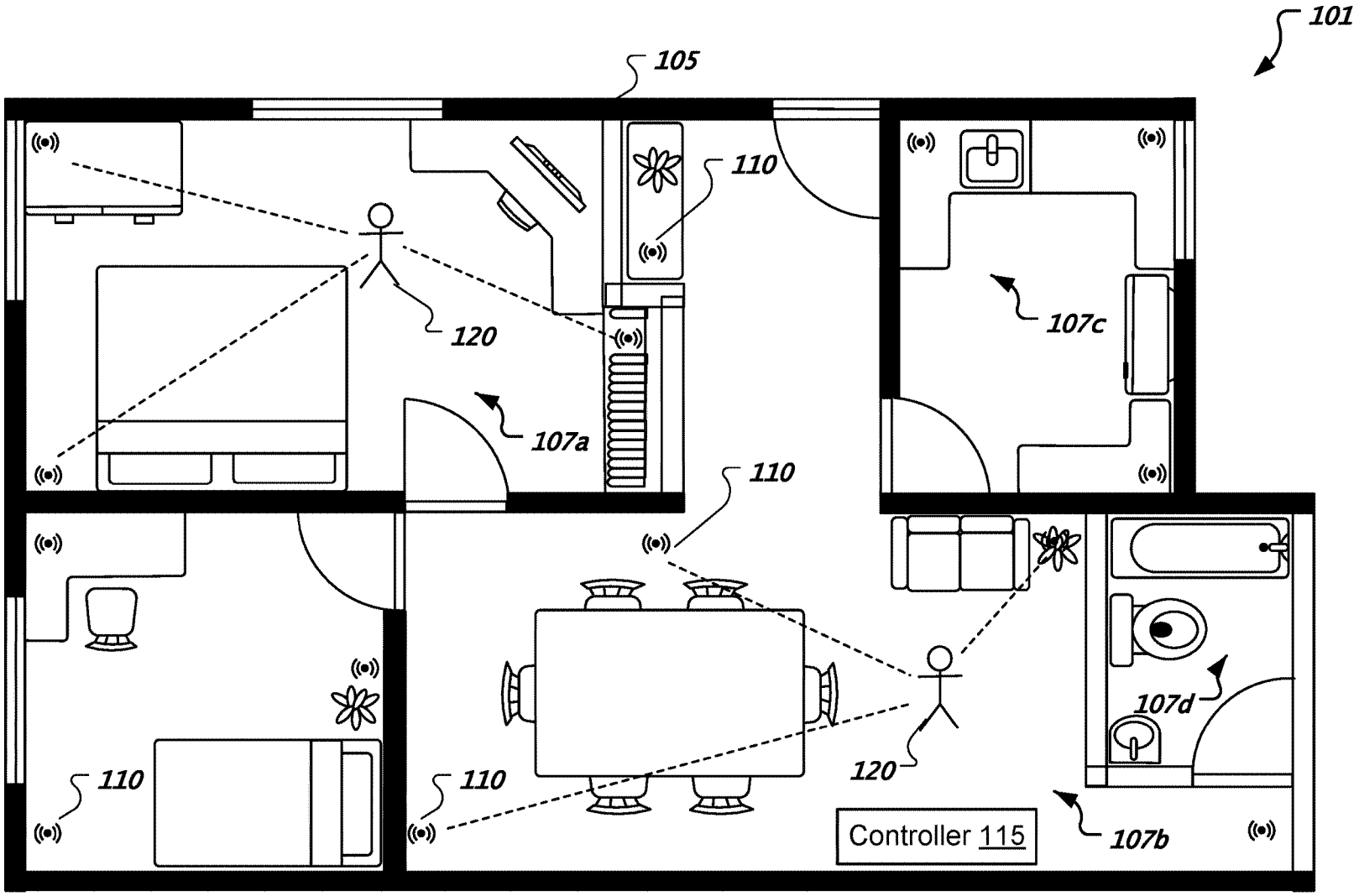
FIG. 1 shows an example of a building outfitted with vibration sensor devices to detect targets within the building.

FIG. 1 shows an example of a building 105 outfitted with vibration sensor devices 110 to detect moving targets 120 within the building 105. The vibration sensor devices 110 can be distributed throughout the building 105 in various rooms such as a master bedroom 107*a*, living room 107*b*, kitchen 107*c*, and bathroom 107*d*. Other room types are possible. The vibration sensor devices 110 can transmit vibration notifications to a controller 115. A vibration notification can include a sensor identifier, a vibration level (e.g., amplitude), and timestamp. Other types of notifications are possible. In some implementations, the vibration sensor devices 110 and the controller 115 can communicate wirelessly. The vibration sensor devices 110 and the controller 115 can form a vibration detection system 101. The system 101 can detect the movements of the target 120 within different rooms 107*a-d* of the building 105. In some implementations, the controller 115 can determine what room 107*a-d* the target 120 is in and the duration of the target's stay in that room. In some implementations, the controller 115 can determine the number of people in a room based on detecting vibrations from their movement.

An installation of vibration sensor devices can include a calibration process to optimize target detection. In some implementations, after installing vibration sensor devices, a controller can prompt a user to provide the locations of the sensor devices on a layout diagram of the property. In some implementations, an application on a user's mobile device can be used to provide the locations of the sensor devices. A triangulation process can use the sensor location data to map vibration detections to sensor locations within the property and determine an origin of a vibration based on those sensor locations. When something happens that causes vibrations, e.g., a person's step or jump, each sensor device may measure those vibrations at different strengths, e.g., vibrational amplitudes. From this, the triangulation process can determine a distance to an origin of the action, i.e., vibration, based on the sensors' vibrational data by comparing relative strength of readings from different sensors. Some sensors may lack the ability to provide directional information. As such, there is a circle of possible origin points around each sensor that detected a vibration, where the diameter of the circle is based on a detected vibrational amplitude. The intersection of three or more circles can provide the location for the origin of a vibration, and hence, the location of where the action occurred.

Figure 2:
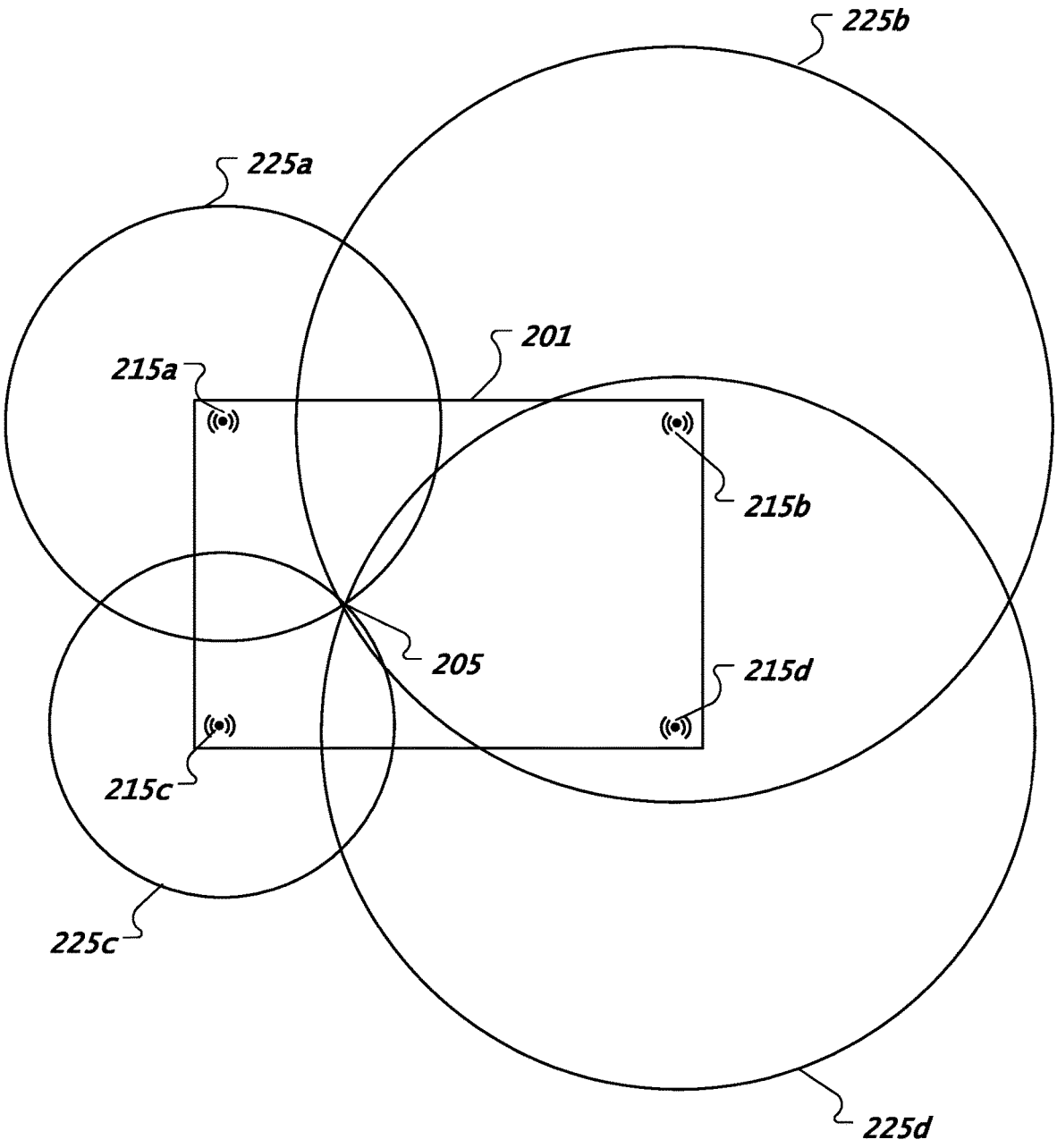
FIG. 2 shows an example of a room outfitted with vibration sensor devices to detect the vibrations generated by a target within the room.

FIG. 2 shows an example of a room 201 outfitted with vibration sensor devices 215*a-d*. The vibration sensor devices 215*a-d* can detect the vibrations generated by a moving target 205 within the room 201. The vibration sensor devices 215*a-d* can transmit vibration notifications to a controller. The controller can collect vibration notifications from the vibration sensor devices 215*a-d* to determine an origination of a set of vibrations. In some implementations, the controller can use the vibration measurements to determine relative time delays due to different propagation times of between a vibration source, e.g., target 205, and respective vibration sensor devices 215*a-d*.

For each sensor device that reported a vibration 215*a-d*, the controller can determine bounding circles 225*a-d* that represent possible vibration origin points. Each bounding circle 225*a-d* is centered about its respective vibration sensor 215*a-d*. The diameter of a bounding circle 225*a-d* can be based on an amplitude of a vibrational wave. As a vibrational wave propagates, its amplitude at a given point becomes weaker. As such, a larger bounding circle 225*b* means that the vibration sensor device 215*b* is farther away from the target 205 relative to a smaller bounding circle 225*c*. The smaller circle 225*c* means that its corresponding vibration sensor 215*c* is closer to the target 205. The controller can determine an intersection of three or more bounding circles 225*a-d* to determine a location for the origin of a vibration, i.e., target 205.

Figure 3:
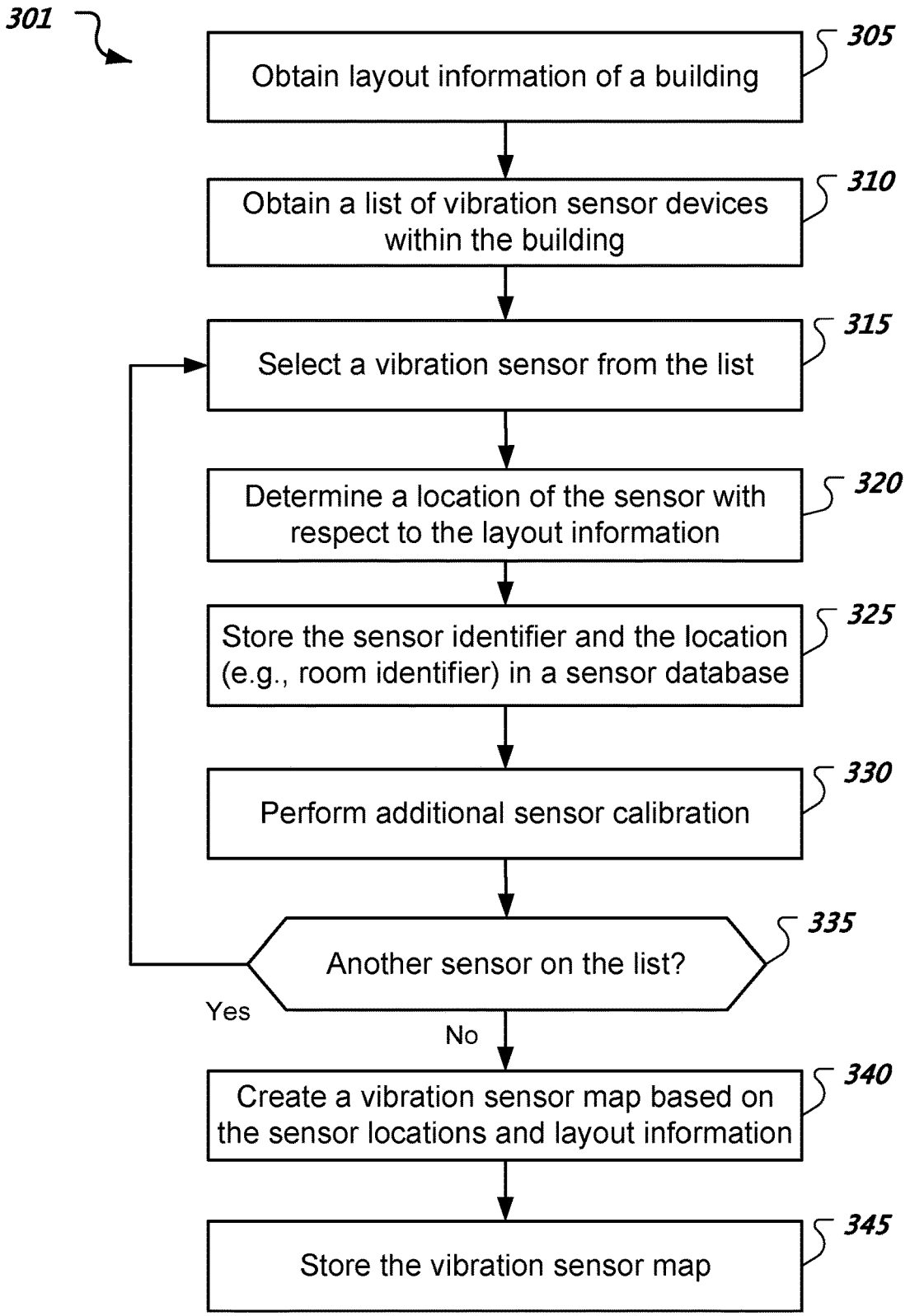
FIG. 3 shows a flowchart of an example calibration process for vibration sensor devices of a triangulation network.

FIG. 3 shows a flowchart of an example calibration process 301 for vibration sensor devices of a triangulation network. The calibration process 301 can be performed at least in part by a controller such as the one shown in FIG. 6. At 305, the controller obtains layout information of a building. Layout information can include architectural diagrams, floor plans, room names, room boundaries, etc. In some implementations, each room can be associated with a room identifier. In some implementations, layout information can be obtained via an imaging platform that takes images of each room in a building. At 310, the controller obtains a list of vibration sensor devices within the building. Obtaining a list of vibration sensor devices can include querying a user via a user interface to input each sensor, accessing a sensor database, or both. In some implementations, the controller can broadcast a signal to cause vibration sensor devices to register with the controller. In some implementations, a vibration sensor device registers with the controller upon power-up. After registering with the controller, the controller can insert a sensor identifier into a sensor database.

At 315, the controller selects a vibration sensor device from the list. At 320, the controller determines a location of the vibration sensor device with respect to the layout information. Determining a sensor location can include querying a user via a user interface to input a location for the sensor. The user interface can display a floor plan, and receive an input (e.g., touch, click, voice) that signifies a location of the sensor device on the floor plan. Sensor location information can include a room identifier. In some implementations, sensor location information includes two-dimensional or three-dimensional coordinates. In some implementations, sensor location information includes a vertical displacement value, e.g., height from the floor if mounted on a wall. At 325, the controller stores the sensor identifier and the location in a sensor database.

At 330, the controller performs additional sensor calibration routines if needed. In some implementations, a sensor calibration routine includes calibrating the sensitivity of the vibration sensor device. In some implementations, a sensor calibration routine includes calibrating a minimum threshold value that controls whether a vibration sensor device will transmit a notification based on detecting a vibrational input. The controller can determine vibrational levels for when someone is walking in the room and for when no one is walking in the room. In some implementations, the controller can prompt a user to walk in the room to make vibrational measurements. In some implementations, the controller can query a user to determine whether someone walked in the room so that it can associate vibrational measurements with whether someone walked in the room or not. The minimum threshold value to trigger a transmission can be based on a vibration level when no one is walking in the room. Further, a vibrational level for when someone is walking in the room can be used to set a vibrational baseline for one or more devices within the room. A vibrational baseline can be used to adjust vibrational amplitudes received from a sensor or to adjust a delay factor to account for differences in vibrational wave propagations (e.g., a sensor placed on a hollow wall or floor may sense a vibration faster than a sensor placed on solid wall or floor).

In some implementations, the controller provides a notification such as an audio and/or visual message to prompt a user to walk in a room containing the selected vibration sensor device to obtain a vibrational baseline for that device. In some implementations, the controller can determine a location of the user via a user's mobile device to further optimize the vibration baseline. In some implementations, the controller can prompt the user to walk in a predetermined pattern in a specific area of the room such as the center.

In some implementations, the controller may prompt the user to re-position the sensor device. For example, if the vibrational levels sensed by the device for when someone is walking in the room is not greater than (or too close to) vibrational levels sensed by the device for when no one is walking in the room, then the controller may prompt the user to re-position the sensor device. This may be the case when the sensor is placed on a surface that significantly dampens vibrational waves.

At 335, the controller determines whether there is another sensor device on the list. If there is, the controller continues at 315. If there are no more sensor devices on the list, the controller continues at 340. At 340, the controller creates a vibration sensor map based on the sensor locations and layout information. At 345, the controller stores the vibration sensor map. In some implementations, the controller may determine that a room lacks a sufficient number of sensors to perform triangulation. For example, the controller can determine that there are less than three sensors in a room, and prompt the user to add one or more additional vibrational sensor devices. In some implementations, to provide full coverage, there would be enough sensors that for every point in a building that will be monitored, an uninterrupted line can be drawn to at least three sensors.

Figure 4:
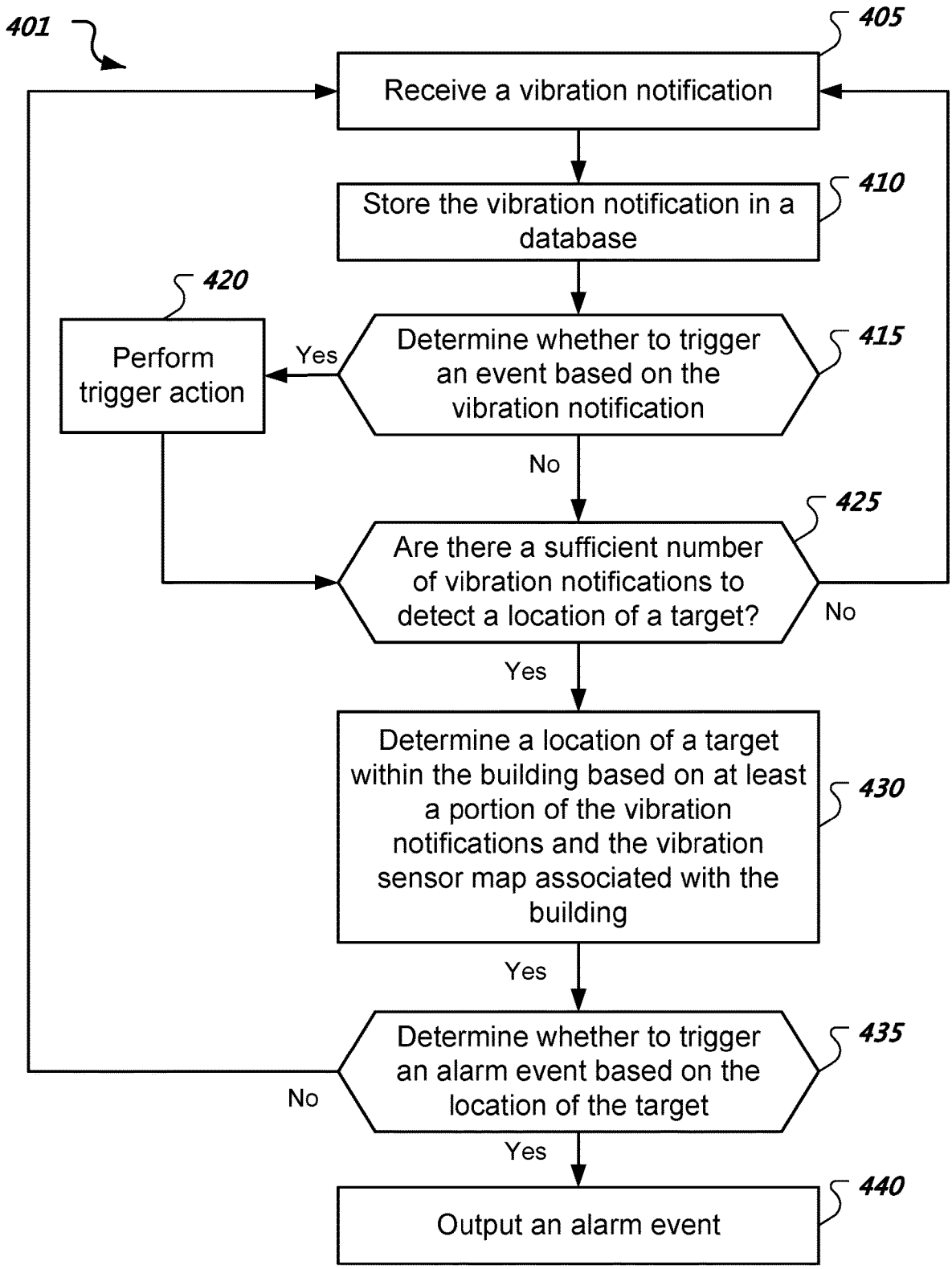
FIG. 4 shows a flowchart of an example detection process that uses information transmitted by vibration sensor devices to detect targets.

FIG. 4 shows a flowchart of a detection process 401 that uses information transmitted by vibration sensor devices to detect targets. The detection process 401 can be performed at least in part by a controller such as the one shown in FIG. 6. At 405, the controller receives a vibration notification from a vibration sensor device. In some implementations, the vibration notification includes a vibration level (e.g., amplitude), timestamp, and sensor identifier. In some implementations, the controller can determine a sensor identifier based on a source network address of a packet that encapsulates the vibration notification. In some implementations, the controller can determine a timestamp based on a time of receiving a notification. At 410, the controller stores the vibration notification in a database. At 415, the controller determines whether to trigger an event based on the vibration notification. If triggered, the controller performs a trigger action at 420 and afterwards continues at 425. For example, an alarm may be triggered if any vibration is detected in the building. If not triggered, the controller continues at 425.

At 425, the controller determines whether there are a sufficient number of vibration notifications to detect a location of a target. Determining whether there are a sufficient number of vibration notifications to detect a location of a target can include querying the database to check whether there are two or more additional vibration notifications from different sensors associated with the same room identifier as the newly received vibration notification. In some implementations, three or more vibration notifications from respective three or more sensors are used to triangulate an origin location for the vibrations. The controller can impose a windowing criterion to filter, e.g., remove or exclude, older vibration notifications that are not relevant or no longer relevant. The controller can use timestamp information to exclude older vibration notifications. In some implementations, the database is implemented as a buffer where vibration notifications that are older than a predetermined time threshold are deleted from the buffer. In some implementations, the buffer is implemented on a per-room basis.

If there is not a sufficient number of vibration notifications, the controller continues at 405 to receive additional notifications. If there is a sufficient number of vibration notifications, the controller continues at 430. At 430, the controller determines a location of a target within the building based on at least a portion of the vibration notifications and the vibration sensor map associated with the building. Determining a location of a target can include converting vibration measurements such as a wave amplitude into distance values for different sensor devices and performing a trilateration and/or triangulation process using the distance values and sensor location information given by the sensor map. In some implementations, the trilateration and/or triangulation process determines potential locations of a target (e.g., circle or circle segment) for each reporting sensor in a room, and determines an overlap among the potential locations to produce a final location for a target at a given point in time. In some implementations, the process obtains time-of-arrival (TOA) information for vibrational waves based on the notifications, and uses TOA information to locate a source of a vibration. In some implementations, vibrational baselines for sensors are used to adjust TOAs to account for differences in vibrational wave propagations (e.g., a sensor placed on a hollow wall or floor may sense a vibration faster than a sensor placed on solid wall or floor). In some implementations, vibrational baselines for sensors are used to adjust vibrational amplitudes to account for differences in vibrational wave propagations.

At 435, the controller determines whether to trigger an alarm event based on the location of the target. In some implementations, the controller can use additional criteria in determining whether to trigger an alarm, such as time-of-day, whether an alarm system is armed, etc. In some implementations, one or more criteria specify a restricted area of a building, and an alarm event can be triggered based on a detection of the target within the restricted area. In some implementations, an area can be classified as a restricted area during one or more predetermined times of the day. If triggered, the controller outputs an alarm event at 440. If not triggered, the controller continues at 405 to receive additional notifications.

In some implementations, the target's determined location is checked against a geo-fence, and if the location is within a fenced-off area, an alarm even is triggered. In some implementations, the controller logs the target's determined location. In some implementations, the controller may determine the number of people present in a room or a building based on their vibrations. In some implementations, the controller forwards the vibration notifications to a server, and the server performs the location determination. In some implementations, the controller can filter, e.g., remove or exclude, vibrations from known sources such as a washer, dryer, refrigerator, or dishwasher. In some implementations, the controller can analyze vibration patterns, and can filter vibrations that have a specific pattern, e.g., slow vibration, fast vibration, etc.

In some implementations, the controller can determine a path of the target within the building based on the vibration notifications. The controller can identify one or more rooms of the building that the target entered based on the path. The controller can perform successive triangulations on vibration notifications as they are received using the map, and identify vibration sources and their corresponding rooms. The controller can generate a list of one or more room identifiers corresponding to the identified one or more rooms.

In some implementations, the controller can receive an appliance notification, e.g., washer is on, and adjust its detection criteria for sensors that are closest to the active appliance, e.g., ignore vibrations from laundry room sensors while the washer is on. For example, a washer or device associated with the washer may provide a notification that informs other devices such as the controller that the washer is on. In some implementations, a calibration process can prompt the user to turn on and off an appliance such as a washer/dryer or dishwasher so that the controller can obtain measurements for when the appliance is on and off. In some implementations, the controller can perform machine learning to separate vibration from known sources, vibrations from pets, vibrations from known occupants, and vibrations from intruders; and selectively trigger an alarm event based on who or what caused the vibrations.

From a commercial standpoint, a business can use a monitoring system equipped with a vibration triangulation network to generate heat maps of customer movement. For example, vibration sensor devices can be placed around a store to detect customer movement throughout the store. Such heat maps can provide insight into a consumer's shopping behavior and help business owners optimize the layout of their stores. For example, a grocery store owner may want to increase sales by optimizing the store layout. The owner installs a vibration triangulation network in the store. After taking data for a period of time, the owner learns where the customers tend to walk around the store based on the generated heat map, and see what areas have the most foot traffic and what areas have the least foot traffic. Given this information, the owner may rearrange one or more aisles so foods which customers are most likely to buy on impulse are near the high-foot traffic areas. The owner may place certain specialty items that are not frequently bought in lower traffic areas.

Figure 5:
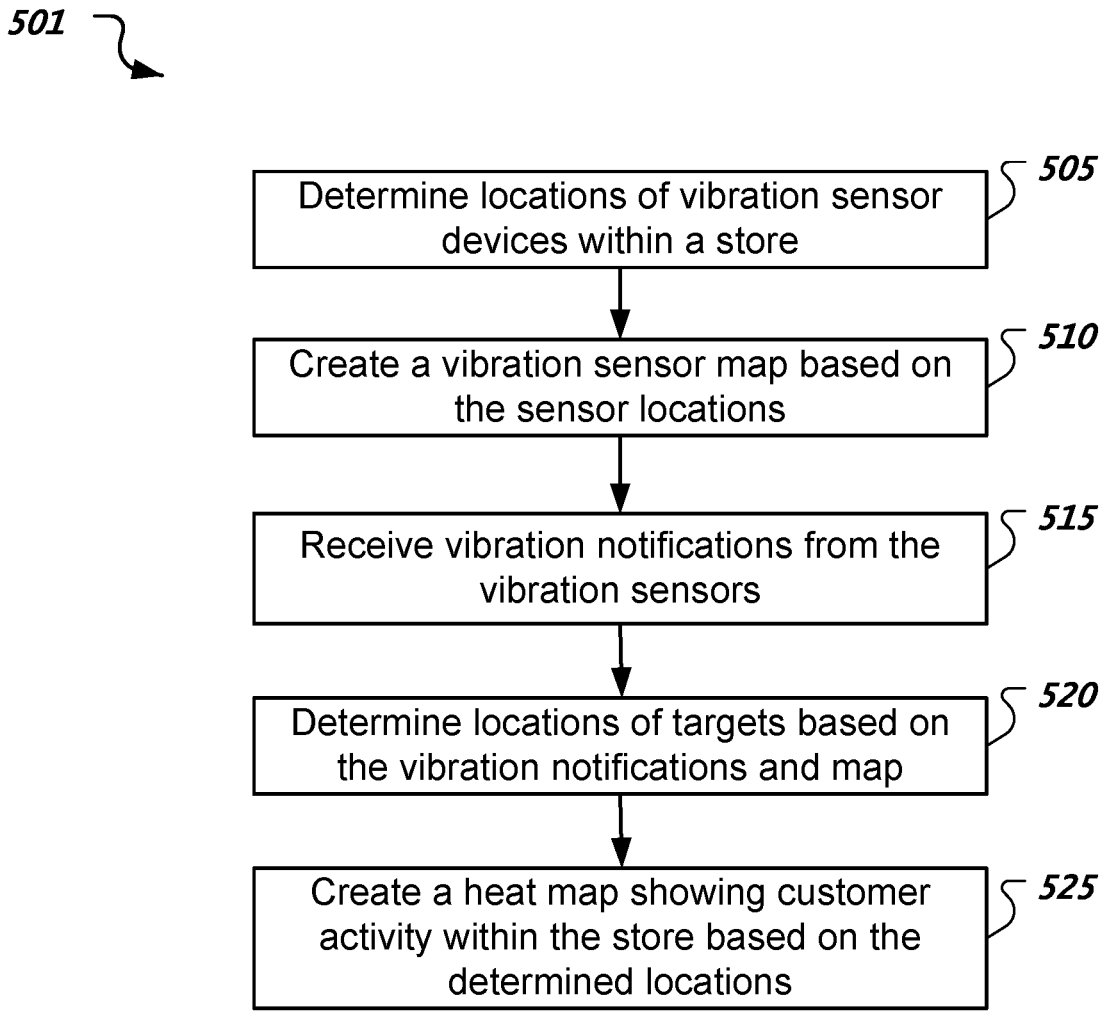
FIG. 5 shows a flowchart of an example process that uses information transmitted by vibration sensor devices located within a commercial area to create an activity heat map.

FIG. 5 shows a flowchart of a process 501 that uses information transmitted by vibration sensor devices located within a commercial area such as a store to create an activity heat map. Various examples of commercial areas include a retail store, amusement park, and office space. Other types of commercial areas are possible. At 505, a controller such as a server determines the locations of vibration sensor devices within a store. The server can be configured to perform a calibration process such as the one described above in relation to FIG. 3. At 510, the server creates a vibration sensor map based on the sensor locations. In some implementations, the vibration sensor map is represented by a data structure having sensor location entries. In some implementations, a sensor location entry includes a sensor identifier and sensor coordinates. In some implementations, a sensor location entry includes a sensor identifier, room identifier, and coordinates.

At 515, the server receives vibration notifications from the vibration sensor devices. In some implementations, the server receives the notifications through a controller located by the sensor devices. At 520, the server determines locations of targets based on the vibration notifications and the vibration sensor map. At 525, the server creates a heat map showing customer activity within the store. In some implementations, the server aggregates the target locations on a map of the store to generate a heat map of customer movement for the store. This can provide insight into consumer's shopping behavior and help business owners optimize the layout of their stores.

Figure 6:
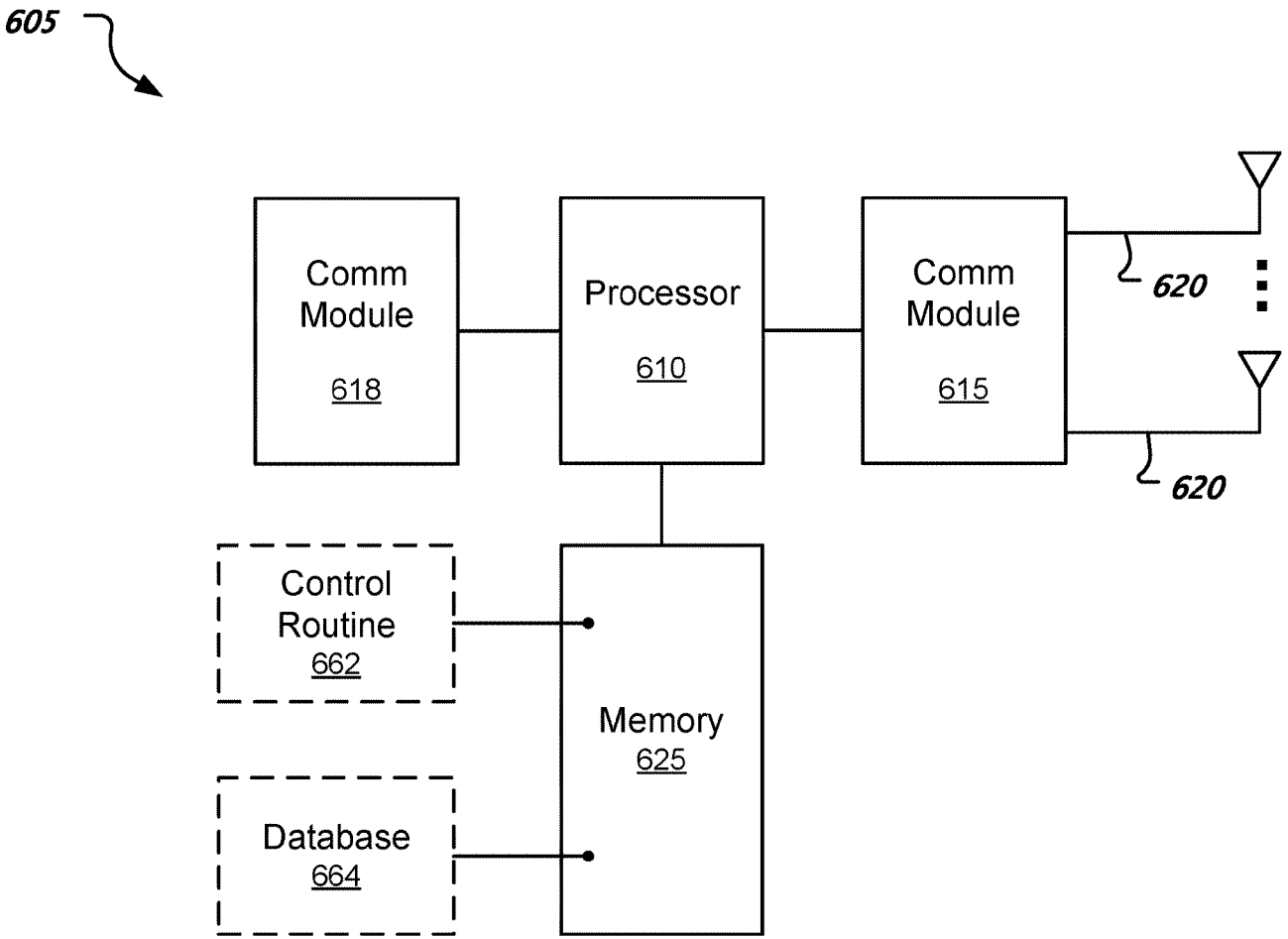
FIG. 6 shows a block diagram of an example of a controller.

FIG. 6 shows a block diagram of an example of a controller 605. The controller 605 can implement one or more techniques presented in this disclosure. The controller 605 includes a processor 610, memory 625, and communication modules 615, 618. The controller 605 includes a processor 610 and a memory 625. In some implementations, the processor 610 includes one or more processor cores. In some implementations, the memory 625 can include random access memory (RAM) and non-volatile memory such as flash memory or a solid state drive (SSD).

The controller 605 includes a communication module 615 to communicate with sensors. The communication module 615 can be coupled with one or more antennas 620. In some implementations, the communication module 615 includes a receiver to receive signals from vibration sensor devices. In some implementations, the controller 605 includes a transceiver that provides the functionality for both communication modules 615, 618. In some implementations, the communication modules 615, 618 can use the same wireless protocol for communications or different protocols. In some implementations, the communication module 615 uses a short-range wireless technology such as IEEE 802.11, Bluetooth, or Z-Wave. In some implementations, the communication module 618 uses wireless technology IEEE 802.11, LTE, GSM, or CDMA for communications. In some implementations, the communication module 618 uses a wireline technology such as Ethernet.

The memory 625 can store information such as data, instructions, or both. In some implementations, the memory 625 can store instructions associated with a calibration process such as the one shown in FIG. 3. In some implementations, the memory 625 can store instructions associated with a detection process such as the one shown in FIG. 4. In some implementations, the memory 625 can store instructions for a control routine 662 that causes the processor 610 to receive vibration notifications from sensor devices via communication module 615, perform a triangulation routine to determine a location of a vibration source, and selectively send an alarm notification via communication module 618. In some implementations, the memory 625 can store instructions for a control routine 662 that causes the processor 610 to receive vibration notifications from sensor devices via communication module 615, and forward the vibration notifications to a server via communication module 618. The processor 610 can be configured to store vibration notifications in a database 664 that resides in the memory 625. In some implementations, the controller 605 can include a vibration sensor device. In some implementations, the controller 605 can be included within a control unit such as control unit 810 of FIG. 8.

Figure 7:
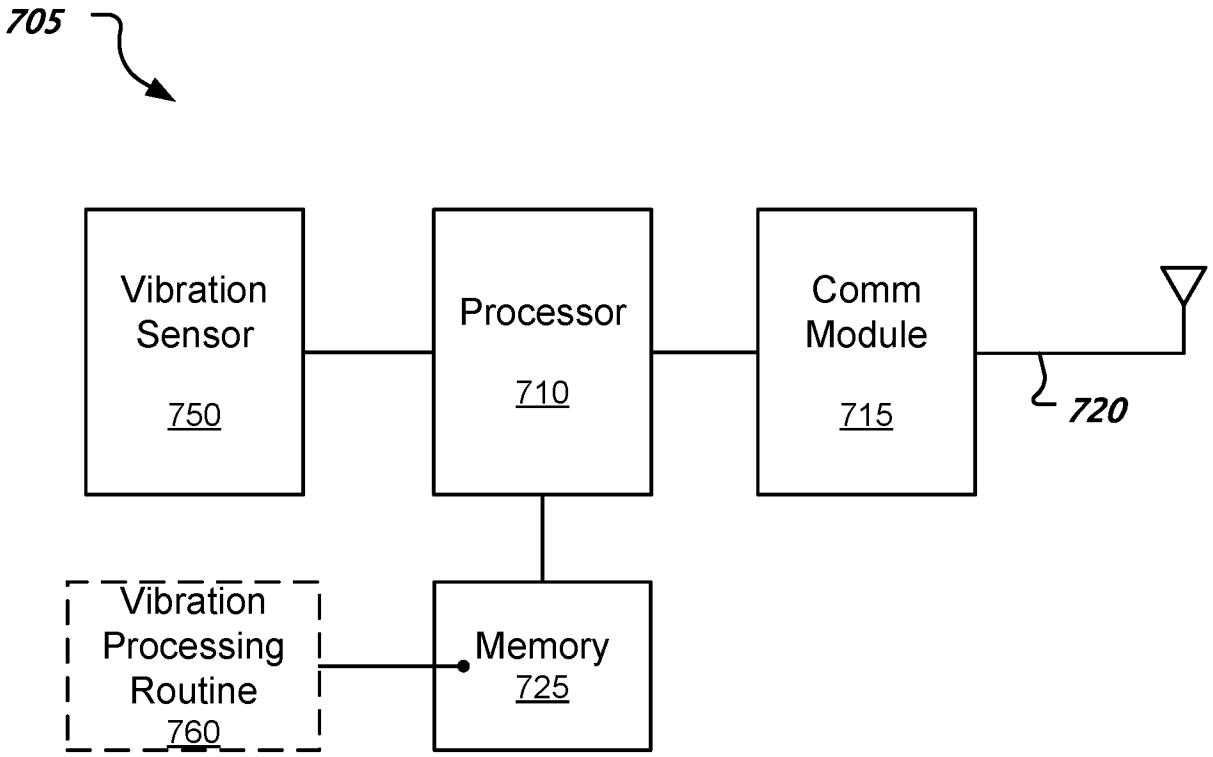
FIG. 7 shows a block diagram of an example of a vibration sensor device.

FIG. 7 shows a block diagram of an example of a vibration sensor device 705. The device 705 can implement methods effecting one or more techniques presented in this disclosure. The device 705 includes a sensor 750, processor 710, memory 725, and a communication module 715. In some implementations, the processor 710 includes one or more processor cores. The sensor 750 is configured to detect vibrations. In some implementations, the sensor 750 includes an accelerometer. In some implementations, the sensor 750 includes a Micro-electro-mechanical System (MEMS) based sensor. In some implementations, the device 705 includes additional sensors such as video, audio, heat, and motion. Other types of sensors are possible. The device 705 includes a communication module 715 to send wireless signals. The communication module 715 is coupled with one or more antennas 720. In some implementations, the communication module 715 includes a transceiver to receive and transmit signals.

The memory 725 can store information such as data, instructions, or both. In some implementations, the memory 725 can store instructions to cause the processor 710 to generate data for transmission. In some implementations, the memory 725 can store instructions to cause the processor 710 to process data received via the communication module 715. In some implementations, the memory 725 can store instructions for a vibration processing routine 760 that collects vibration sensor data from sensor 750, generates vibration notifications based on the sensor data, and transmits the vibration notifications via the communication module 715. In some implementations, the device 705 can quantize sensor data and report a quantized sensor reading to a controller. In some implementations, the memory 725 can store instructions associated with a calibration process. In some implementations, the vibration sensor device 705 can include a controller. In some implementations, a network of vibration sensor devices 705 can select one of the vibration sensor devices to be a control node for the network. In some implementations, the device 705 can communicate with other devices to triangulate an origin of a vibration.

Figure 8:
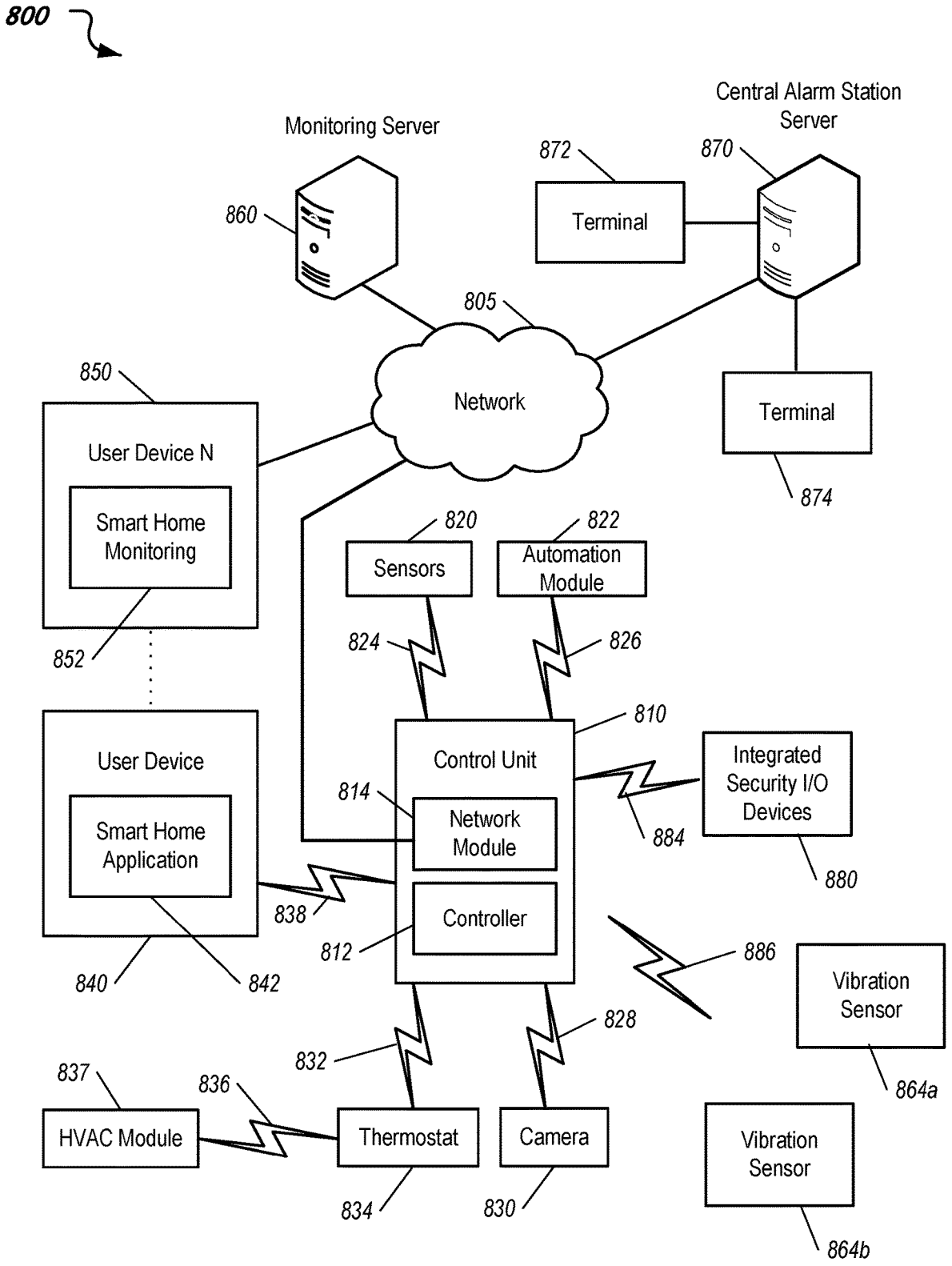
FIG. 8 shows a block diagram of an example security monitoring system.

FIG. 8 shows a block diagram of an example security monitoring system 800. The monitoring system 800 includes a network 805, a control unit 810, one or more user devices 840, 850, a monitoring server 860, and a central alarm station server 870. In some examples, the network 805 facilitates communications between the control unit 810, the one or more user devices 840, 850, the monitoring server 860, and the central alarm station server 870.

The network 805 is configured to enable exchange of electronic communications between devices connected to the network 805. For example, the network 805 may be configured to enable exchange of electronic communications between the control unit 810, the one or more user devices 840, 850, the monitoring server 860, and the central alarm station server 870. The network 805 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 805 may include multiple networks or subnetworks, each of which may include, for example, a wired or wireless data pathway. The network 805 may include a circuit-switched network, a packet-switched data network, or any other network able to carry electronic communications (e.g., data or voice communications). For example, the network 805 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 805 may include one or more networks that include wireless data channels and wireless voice channels. The network 805 may be a wireless network, a broadband network, or a combination of networks including a wireless network and a broadband network.

The control unit 810 includes a controller 812 and a network module 814. The controller 812 is configured to control a control unit monitoring system (e.g., a control unit system) that includes the control unit 810. In some examples, the controller 812 may include a processor or other control circuitry configured to execute instructions of a program that controls operation of a control unit system. In these examples, the controller 812 may be configured to receive input from sensors, flow meters, or other devices included in the control unit system and control operations of devices included in the household (e.g., speakers, lights, doors, etc.). For example, the controller 812 may be configured to control operation of the network module 814 included in the control unit 810.

The network module 814 is a communication device configured to exchange communications over the network 805. The network module 814 may be a wireless communication module configured to exchange wireless communications over the network 805. For example, the network module 814 may be a wireless communication device configured to exchange communications over a wireless data channel and a wireless voice channel. In this example, the network module 814 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 814 also may be a wired communication module configured to exchange communications over the network 805 using a wired connection. For instance, the network module 814 may be a modem, a network interface card, or another type of network interface device. The network module 814 may be an Ethernet network card configured to enable the control unit 810 to communicate over a local area network and/or the Internet. The network module 814 also may be a voice band modem configured to enable the alarm panel to communicate over the telephone lines of Plain Old Telephone Systems (POTS).

The control unit system that includes the control unit 810 includes one or more sensors. For example, the monitoring system may include multiple sensors 820. The sensors 820 may include a lock sensor, a contact sensor, a motion sensor, or any other type of sensor included in a control unit system. The sensors 820 also may include an environmental sensor, such as a temperature sensor, a water sensor, a rain sensor, a wind sensor, a light sensor, a smoke detector, a carbon monoxide detector, an air quality sensor, etc. The sensors 820 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 820 may include a radio-frequency identification (RFID) sensor that identifies a particular article that includes a pre-assigned RFID tag.

As shown in FIG. 8, the system 800 includes vibration sensor devices 864*a-b*. The control unit 810 can communicate with one or more vibration sensor devices 864*a-b* via wireless communication links 886. In some implementations, the control unit 810 performs a triangulation process based on vibration notifications received from the vibration sensor devices 864*a-b*. In some implementations, the control unit 810 can determine that someone entered a room based on inputs from one or more vibration sensor devices 864*a-b*, and can instruct an HVAC module 837 to start cooling or heating a room. In some implementations, the control unit 810 forwards vibration notifications to a server 860, 870 to perform a triangulation process based on the vibration notifications. In some implementations, a server 860, 870 is configured to perform at least part of a vibration sensor calibration process.

The control unit 810 communicates with an automation module 822 and the camera 830 to perform monitoring. The automation module 822 is connected to one or more devices that enable home automation control. For instance, the automation module 822 may be connected to one or more lighting systems and may be configured to control operation of the one or more lighting systems. The automation module 822 may be connected to one or more electronic locks at the property and may be configured to control operation of the one or more electronic locks (e.g., control Z-Wave locks using wireless communications in the Z-Wave protocol. Further, the automation module 822 may be connected to one or more appliances at the property and may be configured to control operation of the one or more appliances. The automation module 822 may include multiple modules that are each specific to the type of device being controlled in an automated manner. The automation module 822 may control the one or more devices based on commands received from the control unit 810. For instance, the automation module 822 may cause a lighting system to illuminate an area to provide a better image of the area when captured by a camera 830.

The camera 830 may be a video/photographic camera or other type of optical sensing device configured to capture images. For instance, the camera 830 may be configured to capture images of an area within a building or within a residential facility 102-A monitored by the control unit 810. The camera 830 may be configured to capture single, static images of the area and also video images of the area in which multiple images of the area are captured at a relatively high frequency (e.g., thirty images per second). The camera 830 may be controlled based on commands received from the control unit 810.

The camera 830 may be triggered by several different types of techniques. For instance, a Passive Infra-Red (PIR) motion sensor may be built into the camera 830 and used to trigger the camera 830 to capture one or more images when motion is detected. The camera 830 also may include a microwave motion sensor built into the camera and used to trigger the camera 830 to capture one or more images when motion is detected. The camera 830 may have a "normally open" or "normally closed" digital input that can trigger capture of one or more images when external sensors (e.g., the sensors 820, PIR, door/window, etc.) detect motion or other events. In some implementations, the camera 830 receives a command to capture an image when external devices detect motion or another potential alarm event. The camera 830 may receive the command from the controller 812 or directly from one of the sensors 820.

In some examples, the camera 830 triggers integrated or external illuminators (e.g., Infra-Red, Z-wave controlled "white" lights, lights controlled by the automation module 822, etc.) to improve image quality when the scene is dark. An integrated or separate light sensor may be used to determine if illumination is desired and may result in increased image quality.

The camera 830 may be programmed with any combination of time/day schedules, system "arming state," or other variables to determine whether images should be captured or not when triggers occur. The camera 830 may enter a low-power mode when not capturing images. In this case, the camera 830 may wake periodically to check for inbound messages from the controller 812. The camera 830 may be powered by internal, replaceable batteries if located remotely from the control unit 810. The camera 830 may employ a small solar cell to recharge the battery when light is available. Alternatively, the camera 830 may be powered by the controller's 812 power supply if the camera 830 is co-located with the controller 812.

The system 800 also includes thermostat 834 to perform dynamic environmental control at the property. The thermostat 834 is configured to monitor temperature and/or energy consumption of an HVAC system associated with the thermostat 834, and is further configured to provide control of environmental (e.g., temperature) settings. In some implementations, the thermostat 834 can additionally or alternatively receive data relating to activity at a property and/or environmental data at a property, e.g., at various locations indoors and outdoors at the property. The thermostat 834 can directly measure energy consumption of the HVAC system associated with the thermostat, or can estimate energy consumption of the HVAC system associated with the thermostat 834, for example, based on detected usage of one or more components of the HVAC system associated with the thermostat 834. The thermostat 834 can communicate temperature and/or energy monitoring information to or from the control unit 810 and can control the environmental (e.g., temperature) settings based on commands received from the control unit 810.

In some implementations, the thermostat 834 is a dynamically programmable thermostat and can be integrated with the control unit 810. For example, the dynamically programmable thermostat 834 can include the control unit 810, e.g., as an internal component to the dynamically programmable thermostat 834. In addition, the control unit 810 can be a gateway device that communicates with the dynamically programmable thermostat 834.

A HVAC module 837 is connected to one or more components of an HVAC system associated with a property, and is configured to control operation of the one or more components of the HVAC system. In some implementations, the HVAC module 837 is configured to monitor energy consumption of the HVAC system components, for example, by directly measuring the energy consumption of the HVAC system components or by estimating the energy usage of the one or more HVAC system components based on detecting usage of components of the HVAC system. The HVAC module 837 can communicate energy monitoring information and the state of the HVAC system components to the thermostat 834 and can control the one or more components of the HVAC system based on commands received from the thermostat 834.

The system 800 further includes one or more integrated security devices 880. The one or more integrated security devices may include any type of device used to provide alerts based on received sensor data. For instance, the one or more control units 810 may provide one or more alerts to the one or more integrated security input/output devices. Additionally, the one or more control units 810 may receive one or more sensor data from the sensors 820, 864*a-b* and determine whether to provide an alert to the one or more integrated security input/output devices 880.

The sensors 820, 864*a-b*, the automation module 822, the camera 830, the thermostat 834, and the integrated security devices 880 communicate with the controller 812 over communication links 824, 826, 828, 832, 884, and 886. The communication links 824, 826, 828, 832, 884, and 886 may be a wired or wireless data pathway configured to transmit signals from the sensors 820, 864*a-b*, the automation module 822, the camera 830, the thermostat 834, and the integrated security devices 880 to the controller 812. The sensors 820, the automation module 822, the camera 830, the thermostat 834, and the integrated security devices 880 may continuously transmit sensed values to the controller 812, periodically transmit sensed values to the controller 812, or transmit sensed values to the controller 812 in response to a change in a sensed value.

The communication links 824, 826, 828, 832, 884, and 886 may include a local network. The sensors 820, 864*a-b*, the automation module 822, the camera 830, the thermostat 834, and the integrated security devices 880, and the controller 812 may exchange data and commands over the local network. The local network may include 802.11 "Wi-Fi" wireless Ethernet (e.g., using low-power Wi-Fi chipsets), Z-Wave, ZigBee, Bluetooth, "Homeplug" or other "Powerline" networks that operate over AC wiring, and a Category 8 (CATS) or Category 8 (CAT6) wired Ethernet network. The local network may be a mesh network constructed based on the devices connected to the mesh network.

The monitoring server 860 is an electronic device configured to provide monitoring services by exchanging electronic communications with the control unit 810, the one or more user devices 840, 850, and the central alarm station server 870 over the network 805. For example, the monitoring server 860 may be configured to monitor events (e.g., alarm events) generated by the control unit 810. In this example, the monitoring server 860 may exchange electronic communications with the network module 814 included in the control unit 810 to receive information regarding events (e.g., alerts) detected by the central alarm station server 870. The monitoring server 860 also may receive information regarding events (e.g., alerts) from the one or more user devices 840, 850.

In some implementations, the monitoring server 860 may route alert data received from the network module 814 or the one or more user devices 840, 850 to the central alarm station server 870. For example, the monitoring server 860 may transmit the alert data to the central alarm station server 870 over the network 805. The monitoring server 860 may store sensor and image data received from the monitoring system and perform analysis of sensor and image data received from the monitoring system. Based on the analysis, the monitoring server 860 may communicate with and control aspects of the control unit 810 or the one or more user devices 840, 850.

The central alarm station server 870 is an electronic device configured to provide alarm monitoring service by exchanging communications with the control unit 810, the one or more user devices 840, 850, and the monitoring server 860 over the network 805. For example, the central alarm station server 870 may be configured to monitor alerting events generated by the control unit 810. In this example, the central alarm station server 870 may exchange communications with the network module 814 included in the control unit 810 to receive information regarding alerting events detected by the control unit 810. The central alarm station server 870 also may receive information regarding alerting events from the one or more user devices 840, 850 and/or the monitoring server 860.

The central alarm station server 870 is connected to multiple terminals 872 and 874. The terminals 872 and 874 may be used by operators to process alerting events. For example, the central alarm station server 870 may route alerting data to the terminals 872 and 874 to enable an operator to process the alerting data. The terminals 872 and 874 may include general-purpose computers (e.g., desktop personal computers, workstations, or laptop computers) that are configured to receive alerting data from a server in the central alarm station server 870 and render a display of information based on the alerting data. For instance, the controller 812 may control the network module 814 to transmit, to the central alarm station server 870, alerting data indicating that a motion detection from a motion sensor via the sensors 820 or from a vibration sensor 864*a-b*. The central alarm station server 870 may receive the alerting data and route the alerting data to the terminal 872 for processing by an operator associated with the terminal 872. The terminal 872 may render a display to the operator that includes information associated with the alerting event (e.g., the lock sensor data, the motion sensor data, the contact sensor data, etc.) and the operator may handle the alerting event based on the displayed information.

In some implementations, the terminals 872 and 874 may be mobile devices or devices designed for a specific function. Although FIG. 8 illustrates two terminals for brevity, actual implementations may include more (and, perhaps, many more) terminals. The one or more user devices 840, 850 are devices that host and display user interfaces. For instance, the user device 840 is a mobile device that hosts one or more native applications (e.g., the smart home application 842). The user device 840 may be a cellular phone or a non-cellular locally networked device with a display. The user device 840 may include a cell phone, a smart phone, a tablet PC, a personal digital assistant ("PDA"), or any other portable device configured to communicate over a network and display information. For example, implementations may also include mobile communication devices, tablets, electronic organizers, portable music players, other communication devices, and handheld or portable electronic devices for gaming, communications, and/or data organization. The user device 840 may perform functions unrelated to the monitoring system, such as placing personal telephone calls, playing music, playing video, displaying pictures, browsing the Internet, maintaining an electronic calendar, etc.

The user device 840 includes a smart home application 842. The smart home application 842 refers to a software/firmware program running on the corresponding mobile device that enables the user interface and features described throughout. The user device 840 may load or install the smart home application 842 based on data received over a network or data received from local media. The smart home application 842 runs on mobile devices platforms, such as iPhone, iPod touch, Google Android, Windows Mobile, etc. The smart home application 842 enables the user device 840 to receive and process image and sensor data from the monitoring system.

The user device 850 may be a general-purpose computer (e.g., a desktop personal computer, a workstation, or a laptop computer) that is configured to communicate with the monitoring server 860 and/or the control unit 810 over the network 805. The user device 850 may be configured to display a smart home user interface 852 that is generated by the user device 850 or generated by the monitoring server 860. For example, the user device 850 may be configured to display a user interface (e.g., a web page) provided by the monitoring server 860 that enables a user to perceive images captured by the camera 830 and/or reports related to the monitoring system. Although FIG. 8 illustrates two user devices for brevity, actual implementations may include more (and, perhaps, many more) or fewer user devices.

In some implementations, the one or more user devices 840, 850 communicate with and receive monitoring system data from the control unit 810 using the communication link 838. For instance, the one or more user devices 840, 850 may communicate with the control unit 810 using various local wireless protocols such as Wi-Fi, Bluetooth, Zwave, ZigBee, HomePlug (Ethernet over powerline), or wired protocols such as Ethernet and USB, to connect the one or more user devices 840, 850 to local security and automation equipment. The one or more user devices 840, 850 may connect locally to the monitoring system and its sensors and other devices. The local connection may improve the speed of status and control communications because communicating through the network 805 with a remote server (e.g., the monitoring server 860) may be significantly slower.

Although the one or more user devices 840, 850 are shown as communicating with the control unit 810, the one or more user devices 840, 850 may communicate directly with the sensors 820 and other devices controlled by the control unit 810. In some implementations, the one or more user devices 840, 850 replace the control unit 810 and perform the functions of the control unit 810 for local monitoring and long range/offsite communication.

In other implementations, the one or more user devices 840, 850 receive monitoring system data captured by the control unit 810 through the network 805. The one or more user devices 840, 850 may receive the data from the control unit 810 through the network 805 or the monitoring server 860 may relay data received from the control unit 810 to the one or more user devices 840, 850 through the network 805. In this regard, the monitoring server 860 may facilitate communication between the one or more user devices 840, 850 and the monitoring system.

In some implementations, the one or more user devices 840, 850 may be configured to switch whether the one or more user devices 840, 850 communicate with the control unit 810 directly (e.g., through link 838) or through the monitoring server 860 (e.g., through network 805) based on a location of the one or more user devices 840, 850. For instance, when the one or more user devices 840, 850 are located close to the control unit 810 and in range to communicate directly with the control unit 810, the one or more user devices 840, 850 use direct communication. When the one or more user devices 840, 850 are located far from the control unit 810 and not in range to communicate directly with the control unit 810, the one or more user devices 840, 850 use communication through the monitoring server 860.

In some implementations, the one or more user devices 840, 850 are used in conjunction with local sensors and/or local devices in a house. In these implementations, the system 800 includes the one or more user devices 840, 850, the sensors 820, 864*a-b*, the automation module 822, and the camera 830. The one or more user devices 840, 850 receive data directly from the sensors 820, the automation module 822, and the camera 830, and send data directly to the sensors 820, the automation module 822, and the camera 830. The one or more user devices 840, 850 provide the appropriate interfaces/processing to provide visual surveillance and reporting. In some implementations, the system 800 provides end users with access to images captured by the camera 830 to aid in decision making. The system 800 may transmit the images captured by the camera 830 over a wireless WAN network to the user devices 840, 850.

In some implementations, a state of the monitoring system and other events sensed by the monitoring system may be used to enable/disable video/image recording devices (e.g., the camera 830). In these implementations, the camera 830 may be set to capture images on a periodic basis when the alarm system is armed in an "Away" state, but set not to capture images when the alarm system is armed in a "Stay" state or disarmed. In addition, the camera 830 may be triggered to begin capturing images when the alarm system detects an event, such as an alarm event, a door-opening event for a door that leads to an area within a field of view of the camera 830, or motion in the area within the field of view of the camera 830. In other implementations, the camera 830 may capture images continuously, but the captured images may be stored or transmitted over a network when needed.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed application-specific integrated circuits (ASICs).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A method comprising:

receiving, by a controller, vibration notifications from vibration sensor devices distributed within a building, comprising:

receiving a first vibration notification from a first vibration sensor device of the vibration sensor devices; and storing the first vibration notification in a database, wherein the database is configured to store previously received vibration notifications from other vibration sensor devices of the vibration sensor devices;

accessing, by the controller, a vibration sensor map associated with the building, the vibration sensor map including sensor location entries for the vibration sensor devices, wherein each of the sensor location entries includes an area identifier identifying an area that one of the vibration sensor devices is located, wherein the first vibration notification corresponds to a first sensor location entry that includes a first area identifier identifying a first area;

determining, by the controller, whether a threshold number of vibration notifications are received to perform a detection in the first area;

in response to determining that the threshold number of vibration notifications are received to perform the detection in the first area, determining a first location of a target by performing a triangulation using the vibration notifications and the vibration sensor map;

receiving additional vibration notifications when the target moves in the building;

determining a likely path of the target within the building by performing two or more successive triangulations using the additional vibration notifications and the vibration sensor map;

determining one or more areas of the building that the target likely entered using the likely path of the target, wherein the one or more areas include the first location;

generating a list of one or more area identifiers corresponding to the one or more areas; and triggering an alarm event using the determination of the one or more areas of the building, the list of one or more area identifiers, and one or more alarm criteria.

2. The method of claim 1, comprising:

filtering one or more of the vibration notifications that correspond to one or more vibrations originating from one or more predetermined vibration sources, wherein the at least a portion of the vibration notifications correspond to one or more vibrations that originate from locations other than the one or more predetermined vibration sources.

3. The method of claim 1, wherein each of the vibration notifications includes a sensor identifier, a vibration amplitude, and a timestamp.

4. The method of claim 3, comprising:

filtering one or more of the vibration notifications based on respective vibrational amplitudes and a predetermined amplitude criterion, wherein the at least a portion of the vibration notifications satisfy the predetermined amplitude criterion.

5. The method of claim 1, wherein the one or more alarm criteria specify a restricted area of the building, and wherein triggering the alarm event comprises triggering the alarm event based on a detection of the target within the restricted area of the building.

6. The method of claim 1, comprising:

performing a calibration process on the vibration sensor devices;

obtaining layout information of the building; and determining locations of the vibration sensor devices located in the building with respect to the layout information, wherein the sensor location entries respectively include the determined locations.

7. The method of claim 6, wherein each of the sensor location entries further comprises a sensor identifier, and sensor coordinates.

8. The method of claim 6, wherein performing the calibration process comprises:

selecting a vibration sensor device to calibrate; and providing a notification to prompt a user to walk in an area containing the selected vibration sensor device to obtain a vibrational baseline for that device.

9. A system comprising:

one or more computers and one or more storage devices on which are stored instructions that are operable, when executed by the one or more computers, to cause the one or more computers to perform operations comprising:

receiving, from at least one of three or more vibration sensor devices located in a building, vibration notifications from the vibration sensor devices, comprising:

receiving a first vibration notification from a first vibration sensor device of the three or more vibration sensor devices;

storing the first vibration notification in a database, wherein the database is configured to store previously received vibration notifications from other vibration sensor devices of the three or more vibration sensor devices;

accessing a vibration sensor map that a) is associated with the building, and b) includes sensor location entries for the three or more vibration sensor devices, wherein each of the sensor location entries includes an area identifier identifying an area that one of the three or more vibration sensor devices is located, wherein the first vibration notification corresponds to a first sensor location entry that includes a first area identifier identifying a first area;

determining whether a threshold number of vibration notifications are received to perform a detection in the first area;

in response to determining that the threshold number of vibration notifications are received to perform the detection in the first area, determining a first location of a target by performing a triangulation using the vibration notifications and the vibration sensor map;

receiving additional vibration notifications when the target moves in the building;

determining a likely path of the target within the building by performing two or more successive triangulations using the additional vibration notifications and the vibration sensor map;

determining one or more areas of the building that the target likely entered using the likely path of the target, wherein the one or more areas include the first location;

generating a list of one or more areas identifiers corresponding to the identified one or more areas; and triggering an alarm event using the determination of the one or more areas of the building, the list of one or more area identifiers, and one or more alarm criteria.

10. The system of claim 9, wherein the operations further comprise:

filtering one or more of the vibration notifications that correspond to one or more vibrations originating from one or more predetermined vibration sources, and wherein the at least a portion of the vibration notifications correspond to one or more vibrations that originate from locations other than the one or more predetermined vibration sources.

11. The system of claim 9, wherein each of the vibration notifications includes a sensor identifier, a vibration amplitude, and a timestamp.

12. The system of claim 11, wherein the operations further comprise:

filtering one or more of the vibration notifications using respective vibrational amplitudes and a predetermined amplitude criterion, wherein at least a portion of the vibration notifications satisfy the predetermined amplitude criterion.

13. The system of claim 9, wherein:

the one or more alarm criteria specify a restricted area of the building, and triggering the alarm event is responsive to detecting the target within the restricted area of the building.

14. The system of claim 9, wherein the operations further comprise:

obtaining layout information of the building, and determining locations of the vibration sensor devices located in the building with respect to the layout information, and wherein the sensor location entries respectively include the determined locations.

15. The system of claim 14, wherein each of the sensor location entries further comprises a sensor identifier and sensor coordinates.

16. The system of claim 14, wherein the operations further comprise performing a calibration process comprising:

selecting a vibration sensor device to calibrate; and providing a notification to prompt a user to walk in an area containing the selected vibration sensor device to obtain a vibrational baseline for that device.

17. The method of claim 1, further comprising:

determining locations of two or more targets using the vibration notifications and the vibration sensor map; and generating a heat map showing activity of the two or more targets within the building using the determined locations of the two or more targets.

18. One or more non-transitory computer storage media encoded with instructions that, when executed by one or more computers, cause the one or more computers to perform operations comprising:

receiving, by a controller, vibration notifications from vibration sensor devices distributed within a building, comprising:

receiving a first vibration notification from a first vibration sensor device of the vibration sensor devices; and storing the first vibration notification in a database, wherein the database is configured to store previously received vibration notifications from other vibration sensor devices of the vibration sensor devices;

accessing, by the controller, a vibration sensor map associated with the building, the vibration sensor map including sensor location entries for the vibration sensor devices, wherein each of the sensor location entries includes an area identifier identifying an area that one of the vibration sensor devices is located, wherein the first vibration notification corresponds to a first sensor location entry that includes a first area identifier identifying a first area;

determining, by the controller, whether a threshold number of vibration notifications are received to perform a detection in the first area;

in response to determining that the threshold number of vibration notifications are received to perform the detection in the first area, determining a first location of a target by performing a triangulation using the vibration notifications and the vibration sensor map;

receiving additional vibration notifications when the target moves in the building;

determining a likely path of the target within the building by performing two or more successive triangulations using the additional vibration notifications and the vibration sensor map;

determining one or more areas of the building that the target likely entered using the likely path of the target, wherein the one or more areas include the first location;

generating a list of one or more area identifiers corresponding to the one or more areas; and triggering an alarm event using the determination of the one or more areas of the building, the list of one or more area identifiers, and one or more alarm criteria.

19. The method of claim 1, wherein determining whether the threshold number of vibration notifications are received comprises querying the database to check whether a second threshold number of vibration notifications from different vibration sensor devices associated with the first area identifier are received, wherein the different vibration sensor devices are different from the first vibration sensor device.

20. The system of claim 9, wherein the one or more areas of the building comprise one or more rooms.

* * * * *